United States Patent [19]

Chronberg

[11] 4,243,378

[45] Jan. 6, 1981

[54] PROCESS AND DEVICE FOR DISPLACING FIRING PLATES THROUGH A TUNNEL KILN

[75] Inventor: Sten Chronberg, Arnieres-sur-Iton, France

[73] Assignee: Agence Nationale de Valorisation de la Recherche (ANVAR), France

[21] Appl. No.: 961,181

[22] Filed: Nov. 16, 1978

[30] Foreign Application Priority Data

Nov. 22, 1977 [FR] France ..... 77 35056

[51] Int. Cl.[3] ..... F27D 3/11

[52] U.S. Cl. ..... 432/11; 432/239; 432/241; 432/246

[58] Field of Search ..... 432/11, 239, 241, 246; 414/159; 104/135

[56] References Cited

U.S. PATENT DOCUMENTS

| | | | |
|---|---|---|---|
| 1,234,786 | 7/1917 | Morris | 432/241 |
| 1,342,041 | 6/1920 | Drinker | 432/241 |
| 1,641,186 | 9/1927 | Meehan | 432/241 |
| 3,127,154 | 3/1964 | Hirschberg et al. | 432/239 |

FOREIGN PATENT DOCUMENTS

| | | |
|---|---|---|
| 2135711 | 12/1972 | France . |
| 2180221 | 11/1973 | France . |

*Primary Examiner*—John J. Camby

*Attorney, Agent, or Firm*—Steinberg & Raskin

[57] ABSTRACT

Process and device for ensuring the displacement, in a tunnel kiln in particular for high-temperature firing of ceramic products, of firing plates traversing the kiln of the type wherein the whole row of plates are pushed at one end of the kiln and roll on balls supported in rolling paths. Parallel grooves are formed on the lower face of the plates to receive the balls and more hollow portions and more protruded portions are provided on the lower face of the places in the said grooves so that when a ball passes under a said protrusion it locally supports a plate and simultaneously relieves of the load the balls of the same rolling path in proximity to the said protrusion what gives a better rolling of the plates and reduces the flow of the balls through the kiln.

11 Claims, 14 Drawing Figures

PROCESS AND DEVICE FOR DISPLACING FIRING PLATES THROUGH A TUNNEL KILN

The present invention has for its object a process and a device for ensuring the displacement in tunnel kilns, in particular for firing to a high temperature ceramic products, of firing plates which traverse the kiln while supporting the products to be fired. More precisely, the invention relates to applications to kilns of the type according to which there are pushed at one end of the kiln a whole row of plates which roll on balls supported in rolling paths, whereas parallel grooves with the same spacing as the said paths are formed on the lower face of the plates to receive the balls which simultaneously ensure a lateral guiding of the plates.

Such a kiln has been described notably in French Pat. No. 2.135.711 (registration no. 71.14.723) filed in the name of Mr. Sten CHRONBERG and in the Certificate of Addition no. 2.180.221 (registration no. 72.13.030) to that patent.

Although with respect to the known devices the installations described in the said patent and in the Certificate of Addition thereto offer unquestionable advantages, various difficulties arise in practice, especially as regards the more or less irregular rolling of the balls in the kiln, the risks of plates overlapping which, also scarce, are not completely removed, the loss of a certain number of balls in the kiln and the production within the firing volume of the kiln of undesirable dust carried along or entrained by the balls.

According to the process of the invention which uses firing plates which traverse the kiln by rolling on balls guided in rolling paths, in order to limit the frictional forces the said plates are supported by a restricted number of said balls which roll in said rolling paths and in parallel grooves with the same spacing formed on the lower face of the plates, by providing in the said grooves more hollow and more protruded portions so that when a ball passes under a said protrusion it locally supports a plate and at the same time relieves from at least the major portion of the load the balls of the same rolling path which possibly are located in proximity to the said protrusion under a said more hollow portion. In this manner, one obtains a better rolling of the plates which roll on a limited, barely sufficient number of balls and one avoids a simultaneous pushing in their rolling path of a great number of balls which do not work and only result in a braking action on the plates during their advancing motions, an abrasion of the balls between themselves and in risks of derailment. Also, in this manner, one considerably reduces in the kiln the rate at which the balls traverse it per unit of time, thus limiting friction, the causes of wear and the thermal inertia of the balls whose temperature necessarily follows the curve of temperature rise and temperature fall in the tunnel kiln all along its path.

The invention also relates to a device allowing the above-mentioned process to be carried out, said device being characterized in that the rolling paths in which the balls roll are substantially horizontal, the grooves provided on the lower face of the plates in parallel relationship to the said paths comprise more protruded portions forming skids on which the said plates roll when a ball in the rolling path is plumb with the said skid.

Advantageously, at least one skid is preferably provided on each side of the said plates, on either side of a medial plane parallel with the direction of advancement of the plates and at least three skids are provided for each plate. Thus, each plate is usually supported by three skids each of which rolls on a ball which, advancing at half the speed of the plate, is replaced after a certain length of path by an other ball present in the rolling path and as will appear later.

According to a modified form of embodiment of the invention particularly suitable for transportation of heavy loads, there are provided under the said plates with a greater number of skids mounted separately and confined within the said grooves provided under the plates and in which they have some play, in particular vertical play. Thus, depending on the position of the load on the plate and on the advance of the plate in the kiln a certain number of skids will successively support the load by rolling on the subjacent balls, while other skids will not be working as a result of the provided vertical plate.

The invention will appear more clearly from the following description made with reference to the appended drawings illustrating by way of example various forms of embodiment.

Figure 1:
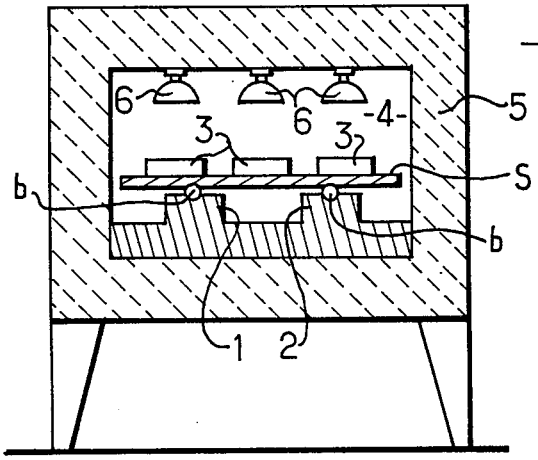
FIG. 1 is a diagrammatic vertical sectional view through the tunnel kiln comprising firing plates advancing on rows of balls.

Reference is first made to FIG. 1 diagrammatically illustrating a tunnel kiln comprising support plates S rolling on balls b themselves guided on two rolling paths 1, 2. Plates S support the products 3 to be fired within the heated space 4 of the kiln, the insulating wall of which is indicated at 5. At 6 are shown heating means, e.g. for radiant heating.

As mentioned previously, rolling problems which are difficult to solve arise in such a kiln. Those problems are solved according to the present invention as will be now described.

Figure 2:
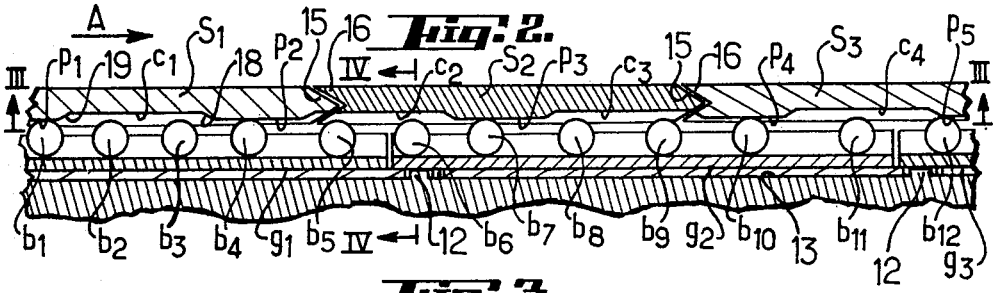
FIG. 2 is a longitudinal sectional view, to a larger scale and broken-away along a tunnel kiln substantially in the plane of a ball rolling path upon the line II—II of FIG. 3.
Figure 3:
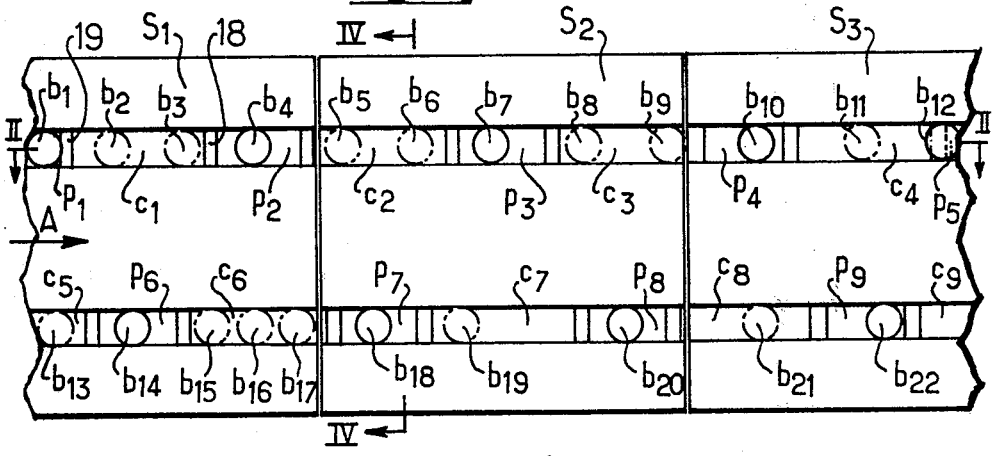
FIG. 3 is a horizontal sectional view from below, substantially through the plane III—III of FIG. 2 and illustrating two parallel rolling paths supporting the firing plates.
Figure 4:
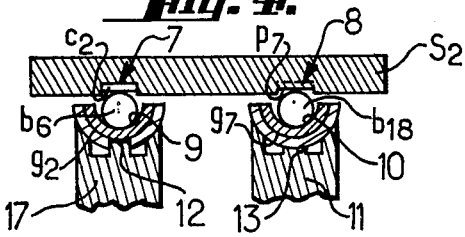
FIG. 4 is a vertical sectional view in the plane IV—IV indicated in FIGS. 2 and 3.

According to the form of embodiment illustrated in FIGS. 2 to 4, the support plates S, three of which, S1, S2, S3 are visible, are formed, on their lower face (see FIG. 4), with parallel grooves 7, 8, the spacing between which is the same as that between the rolling paths 9, 10 in which the balls b roll. Furthermore, the grooves 7, 8 comprise more protruded portions forming skids p and more hollow portions c.

In the example illustrated and as appears more clearly in FIG. 3 each support plate S is formed with three skids such as p1, p2, p6 for the plate S1 and p3, p7, p8 for the plate S2, the said skids being in staggered arrangement forming a load support triangle favourable to the plate. Two skids such as p1–p2, p7–p8 on one side of the plate are separated by a hollow c1, c7, whereas each skid isolated on the other side such as p6, p3 is surrounded by two hollow portions such as c5–c6, c2–c3.

As regards the rolling paths 9, 10 they are constituted by gutter-shaped members, which are as horizontal and continous as possible. In the example illustrated, these gutter-shaped members, which, like the balls b and the firing plates S, are of ceramic material, are mounted end to end, with their ends assembled to one another by means of half-lap joints, i.e. fitted in one another by means of respective end notches at half-depth, as will be described in more detail in FIG. 7. In FIG. 2 are seen three gutter-shaped members g1, g2, g3 forming a portion of the rolling path 9, and in FIG. 4, a gutter-shaped member g7 forming a portion of the other rolling path 10.

The gutter-shaped members g are supported on the kiln hearth or floor (not shown) by rails or guides 11, 17 which at the same time prevent them from rotating owing to the provision of tenons 12 projecting from the support surface 13 of the gutter-shaped members at each end thereof and engaging into a corresponding mortise 14 (FIG. 7) of the gutter member.

Futhermore, as appears clearly in FIG. 2, each support plate S is formed at one end with a bevelled portion 15 engaging into a corresponding hollow portion 16 adjacent to the following plate. A fitting of the ends of the plates into one another is thus obtained when the latter are continuously pushed forward through the kiln.

The operation of the device will now be explained.

The plates advancing through the kiln by being pushed in the direction of arrow A (FIGS. 2 and 3), each plate such as S1 pushes the following plate S2, which pushes the plate S3, and so forth.

Every time a new plate S is introduced into the kiln, a certain number of balls are simultaneously engaged into the rolling paths 9, 10, for example one ball on each side upon each introduction of a plate.

Assuming, as illustrated in FIGS. 2 and 3, that at a given instant the plate S1 is supported by its three skids p1, p2, p6 by rolling on three balls b1, b4, b14, the advancing motion of the support plate S1 takes place as follows.

It is apparent, in the first place, that the balls such as b2, b3, b13, b15, b16, b17 located under the recessed portions c1, c5, c6 of the plate S1 will not be affected by the motion of the plate S1 so long as they remain under the said recessed portions without contacting the plate S1. These balls therefore remain stationary. On the other hand, the three balls b1, b4, b14 supporting the plate S1 advance at the same time as this plate by rolling thereunder and at a speed equal to half the advancing speed of the plate. This will continue so long as the balls are under the skids. Advantageously, the skid length is about 3 to 5 times the diameter of the balls. By way of example, the balls may be 10 mm in diameter, the length of the skids and the hollows being on the order of 40 mm.

Under such conditions, when the plate S1 travels through a length equal to twice the length of a skid, the plate support balls rolling under the skids advance through a length equal to that of a skid and therefore disengage therefrom and fall under and adjacent hollow. Simultaneously with this motion, each skid such as p1, p2, p6 will meet in front of it another ball such as b2, b5, b15 waiting under an adjacent hollow c1, c2, c6. The engagement of a ball under the skid and its disengagement from the skid are facilitated by connecting portions 18, 19 (FIG. 2) with inclined surfaces.

In order to facilitate the reading of the Figures, there are shown in FIG. 3, in discontinuous lines, the balls in rest position, such as b2, b3, b5, which are not rolling due to the fact that they are under hollow portions of the support plates S, and in full lines the balls such as b1, b4, b7 which are rolling and supporting the plates through their skid p.

If, by accident, one of the skids or several skids of a plate should happen to be momentarily disengaged from subjacent balls, for example if no ball b7 should be located under the skid p3, it is apparent that the plate S2 will nevertheless remain horizontal owing to the fitting of the mating ends 15, 16 of the adjacent support plates in one another. In other words, if one of the plates were not momentarily and locally supported by the balls rolling thereunder, they would remain supported by the adjacent plates.

Lastly, the plays are so calculated that if, by accident, no balls should happen to be located under the skids of several adjacent plates simultaneously, the plates would roll on the balls present in the hollows c without the plates bearing directly upon the surface of the rolling paths or on the sides of the kiln. Such a rolling could only be of very short duration, for balls would very rapidly be again present under the skids.

In the form of embodiment just described, it should be noted that the width of the rolling grooves with their more hollow portions c and their skid portions p is substantially equal to the diameter of the balls. As regards the width of the rolling path, the gutter-shaped members g will be slightly greater in diameter than the balls so as to ensure a good rolling and, simultaneously, a correct lateral guiding of the plates.

Figure 5:
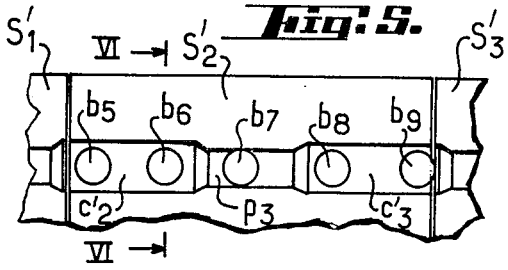
FIG. 5 is a partial view showing, as FIG. 3, a modified form of embodiment of the grooves formed under the firing support plates.
Figure 6:
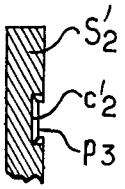
FIG. 6 is a sectional view in the plane VI—VI of FIG. 5.

In a modified form of embodiment illustrated in FIGS. 5 and 6, the hollow portions c' of the support plates S' are given a width greater than that of the skids p', which remains substantially equal to the diameter of the balls. Thus, the balls such as b5, b6, b8, b9 will be more reliably prevented from being driven along when they are in their rolling path under the hollow portions such as c'2, c'3. Simultaneously, a good lateral guiding of the support plates S' by the skids of reduce width such as p3 is preserved.

Figure 7:
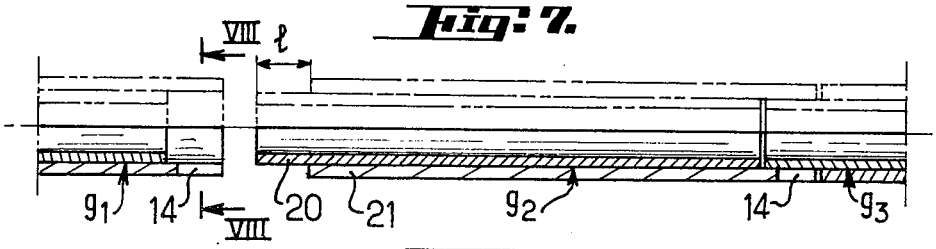
FIG. 7 is a longitudinal vertical sectional view through a rolling path, showing how the latter is obtained.
Figure 8:
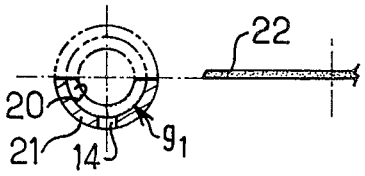
FIG. 8 is a cross-sectional view in the plane VIII—VIII of FIG. 7 illustrating with the latter figure a process for manufacturing such rolling paths.

In FIGS. 7 and 8 are illustrated in more detail the gutter-shaped members g1, g2, g3 constituting the active portion of the rolling path receiving the balls. Each gutter member g is formed from an internal pipe 20 of ceramic material on which is sealed a pipe 21 which also is of ceramic material and is slightly greater in diameter and equal in length, with a longitudinal shift 1. The composite pipe thus obtained can thereafter be cut diametrically, e.g. by means of a grinding wheel 22 as illustrated in FIG. 8, so as to leave a gutter-shaped member g. Also, each end may be provided with a mortise 14 for engaging therein the tenon 12 (FIGS. 2 and 4) preventing the gutter members from rolling on their supports 11, 19. The longitudinal shift 1 of the pipes 20, 21 ensures a fit-in assembly of the gutter members end to end by means of respective end notches at half-depth of the thickness of the gutter member walls (half-lap joints), thus forming the rolling path for the balls.

Figure 9:
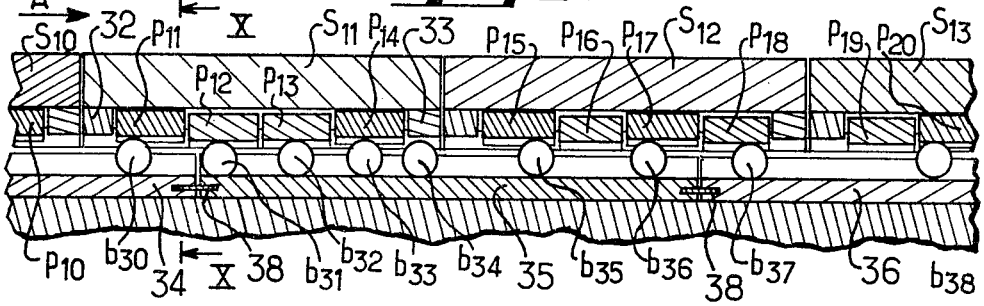
FIG. 9 is a longitudinal sectional view in parallel relationship to a rolling path of the kiln and with parts broken away to show, as in FIG. 2, another form of embodiment particularly suitable for the transportation of heavy loads.
Figure 10:
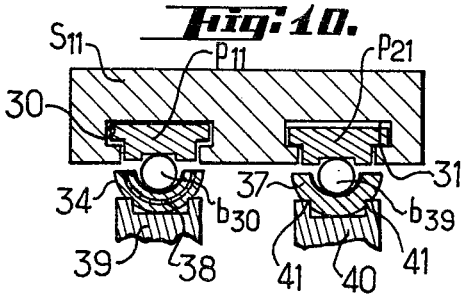
FIG. 10 is a cross-sectional view in the plane X—X of FIG. 9 in transverse relationship to a support plate rolling on those rolling paths.

Reference is now made to FIGS. 9 and 10 in which is illustrated another form of embodiment of the invention particularly suitable for the transportation of heavy loads through a kiln.

Whereas in the previous forms of embodiment described the skids formed in the grooves provided on the lower face of the support plates formed directly part of the said plates, in the form of embodiment of FIGS. 9 and 10 the skids are separate members inserted and confined in the said grooves, in which they have a certain play, in particular a vertical play.

More specifically, in each support plate which may be relatively thick such as S11 are formed two grooves 30, 31 parallel with the ball rolling paths, and in the said grooves are inserted skids such as p11, p21 (FIG. 10) confined in the said grooves, but with a certain vertical play.

In the example illustrated, each support plate S comprises on each side four skids thus mounted, such as p11, p12, p13, p14 (FIG. 9). The skids cannot escape from the said grooves owing to the provision of ends blocks 32, 33, e.g. of ceramic material, appropriately cemented to the ends of the said grooves.

Figure 12:
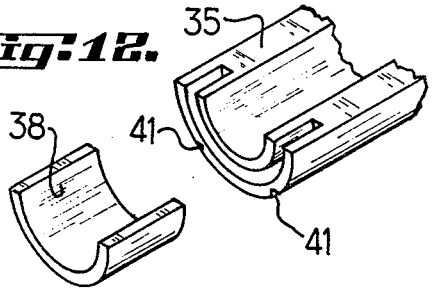
FIG. 12 is an exploded perspective view illustrating one way of obtaining the rolling paths used in the embodiments of FIGS. 9 to 11.

As regards the ball rolling paths proper, they are formed by gutter-shaped members of ceramic material such as 34, 35, 36, 37, mounted end to end and retained in alignment by any appropriate means such as ceramic keys 38 (FIGS. 9 and 12), the said gutter-shaped members themselves being supported on rails or rolling paths 39, 40 and prevented from rotating by cuts 41 appropriately engaged on the support rails 39, 40.

The device operates as follows.

When the plates are advanced in the direction of arrow A (FIG. 9) by being pushed against one another by the first plate introduced into the kiln, each plate such as for example S11 meets under its skids a certain number of balls which roll in the subjacent rolling paths. Owing to the relatively important loads (not shown) placed on the support plates S, the latter are more or less deformed and subjected to bending and torsional stresses. Under such conditions, and depending on the plays of the rolling paths, of the balls of different diameter, etc, each support plate S is supported at a given instant by only a certain number of its skids, for example the skids p11 and p14 for the plates S11 as regards the rolling path 39, these skids rolling on two balls b30, b33. These skids are therefore applied to the bottom of the corresponding groove 30 of the plate S11. On the other hand, the other two skids p12 p13 of the same plate and of the same groove are somewhat lowered and are not supporting the plate S11. On the other hand, they are applied by their own weight on the balls b31, b32 present at that location on the rolling path. Consequently, in the advancing path of the plate S11, all the balls b30, b31, b32, b33 present under the skids p11 to p14 advance simultaneously at a speed equal to half the speed of the plate.

It is understood that in this manner a very good equal distribution of the balls in the kiln all along the rolling paths is ensured, their stagnation in the kiln is avoided and successive regular work is ensured upon their passing from one skid to the following.

Figure 11:
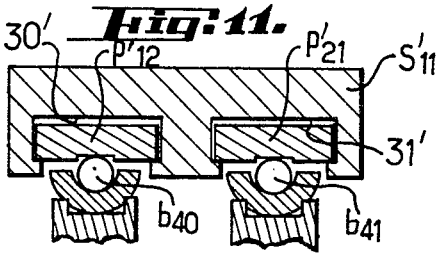
FIG. 11 is a sectional view similar to that of FIG. 10 showing a modified form of embodiment of the skids.

The modified form of embodiment illustrated in FIG. 11 shows a plate S'11 with skids p'12 p'21 shaped a little differently, but also mounted confined in grooves 30', 31' according to the same operating principle.

Of course, many modifications may be made in the carrying out and the embodiment of the invention.

Thus, for example, in the "heavy" embodiment described in FIGS. 9 to 11, all the skids were assumed to be of the same height. They may, if desired, be given different heights or, more generally, provisions can be made in order that, when all the inserted skids are applied against the bottom of the groove they are not substantially level on a same plate. There would thus be created locally higher skids which would normally support the skids, being for example arranged at three points of a triangle somewhat as illustrated in the form of the embodiment of FIG. 3.

Figure 13:
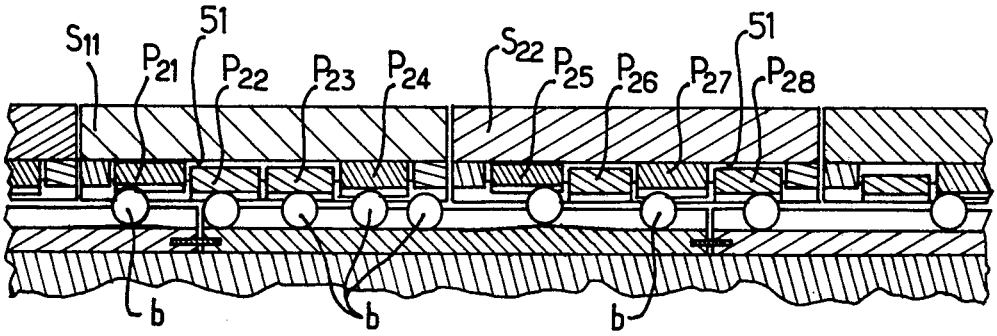
FIG 13 is a longitudinal sectional view in parallel relationship to a rolling path of the kiln and with parts broken away illustrating another embodiment of the invention particularly suitable for the transportation of heavy loads.
Figure 14:
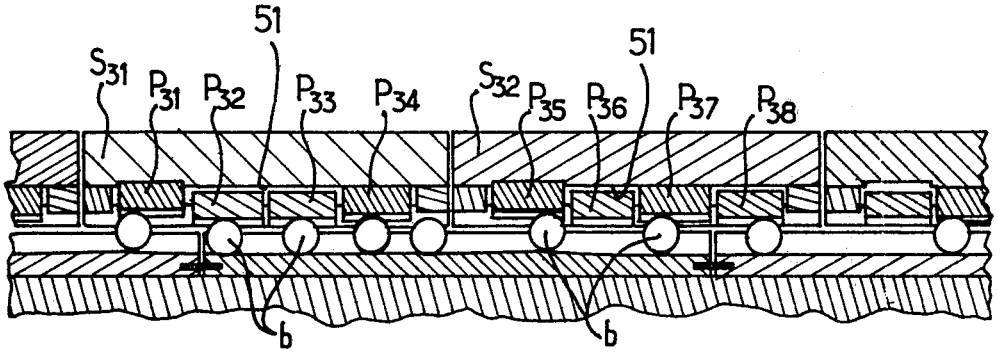
FIG. 14 is a view similar to FIG. 13 illustrating yet another embodiment of the invention which is particularly suitable for the transportation of heavy loads.

More particularly, FIGS. 13 and 14 illustrate two embodiments of the invention particularly suitable for the transportation of heavy loads wherein the inserted skids on a particular plate are not all substantially level when applied on the bottom of the respective groove in which they are inserted. Thus, FIG. 13 illustrates an embodiment wherein the skids inserted within the groove 51 of plates S11-S22 have different heights. For example, the heights of skids P21, P22, and P23 are smaller than the height of skid P24 and wherein the height of skid P25 is less then the height of skid P27. As clearly seen in FIG. 13, when applied on the bottom of groove 51, the inserted skids are not all substantially level on a particular plate. FIG. 14 illustrates an embodiment wherein skids P31 to P38 of plates S31 and S32 have the same height. However, the grooves 51 are provided with recesses corresponding in location to skids P31 and P35. In this manner, provisions are made such that when all the inserted skids are applied against the bottom of the groove 51, they are not substantially level on the same plate.

The invention therefore comprises all technical equivalents to the means described as well as their combinations should the latter be carried out according to its spirit and used within the scope of the following claims.

What is claimed is:

1. A process for ensuring the displacement of firing plates through a tunnel kiln particularly adapted for high-temperature firing of ceramic products supported by the firing plates as the latter traverse the kiln, and wherein the plates are arranged in a row at one end of the kiln and are supported on balls which themselves are supported in parallel rolling paths and wherein parallel grooves corresponding in spacing to the parallel rolling paths are formed on the lower faces of the plates which receive the balls to simultaneously ensure a lateral guiding of the plates, comprising the steps of:

providing within the grooves in the lower faces of the plates relatively hollow and protruded portions so that the plates are supported by a restricted number of the balls in the rolling paths and corresponding grooves; and pushing the row of plates at the one end of the kiln so that when a ball passes under a relatively protruded portion of a plate it locally supports the plate and simultaneously relieves the balls arranged in the same rolling path possibly located in a relatively hollow portion proximate to the relatively protruding portion from at least the major portion of the load applied by the plate.

2. In a device for ensuring the displacement in tunnel kilns, in particular for high-temperature firing of ceramic products, of firing plates which traverse the kiln while supporting the products to be fired including a row of plates adapted to be pushed at one end of the kiln, a plurality of balls supported in rolling paths on which balls the plates roll, and parallel grooves with the same spacing as that of the said paths formed on the lower face of the plates to receive the balls which simultaneously ensure a lateral guiding of the plates, the said rolling paths being substantially horizontal, the improvement comprising protruded portions formed within said grooves and extending longitudinally therewithin defining skids on which the said plates roll when a ball is present in the rolling path vertically beneath said skid.

3. A device according to claim 2, wherein at least one skid is preferably provided on each side of the said plates, on either side of the medial plane parallel with the direction of advance of the plates.

4. A device according to claim 3, wherein at least three skids are provided for each plate.

5. A device according to claim 3, wherein the length of each skid is preferably of the order of from 3 to 5 times the diameter of the balls.

6. A device according to claim 2, wherein the said skids are formed directly by the lower portion of the plates.

7. A device according to claim 2, wherein the said skids comprise separate skid members adapted to be inserted into and confined within said grooves and said skid members and grooves are provided with cooperating means for providing a predetermined vertical play of said skid members within said grooves.

8. A device according to claim 7, wherein the said inserted skid members, when applied on the bottom of their groove, are all substantially level on a same plate.

9. A device according to claim 7, wherein the said inserted skid members, when applied on the bottom of their groove, are not all substantially level on a same plate.

10. A device according to claim 2, wherein the said rolling paths are formed by ceramic half-pipes whose ends are fitted in one another by joint means.

11. A device according to claim 2, wherein the said plates are formed at their adjacent edges with corresponding fit-in connection means.

* * * * *